US005782126A

United States Patent [19]

Drigani et al.

[11] Patent Number: 5,782,126

[45] Date of Patent: Jul. 21, 1998

[54] DEVICE TO REPLACE THE ROLLS IN A FOUR-HIGH ROLLING STAND FOR SHEET AND/OR WIDE PLATE

[75] Inventors: Fausto Drigani, Zugliano-Pozzuolo del Friuli; Estore Donini, Vimercate, both of Italy

[73] Assignee: Danieli & C. Officine Meccaniche SpA, Buttrio, Italy

[21] Appl. No.: 845,190

[22] Filed: Apr. 21, 1997

[30] Foreign Application Priority Data

Apr. 19, 1996 [IT] Italy ..... UD96A0052

[51] Int. Cl.[6] ..... B21B 31/07; B21B 31/08

[52] U.S. Cl. ..... 72/239

[58] Field of Search ..... 72/237, 238, 239, 72/245, 247, 240

[56] References Cited

U.S. PATENT DOCUMENTS

| | | | |
|---|---|---|---|
| 3,540,254 | 11/1970 | Bode, Jr. | 72/239 |
| 3,543,556 | 12/1970 | Wolfendale | 72/238 |
| 4,155,240 | 5/1979 | Okuda et al. | 72/239 |
| 4,308,741 | 1/1982 | Ishii et al. | 72/239 |
| 4,552,007 | 11/1985 | Mantovn | 72/239 |

FOREIGN PATENT DOCUMENTS

| | | |
|---|---|---|
| 1022997 | 1/1958 | Germany . |
| 3110377 | 10/1982 | Germany . |

*Primary Examiner*—Lowell A. Larson
*Assistant Examiner*—Rodney Butler
*Attorney, Agent, or Firm*—Antonelli, Terry, Stout & Kraus, LLP

[57] ABSTRACT

Device to replace the rolling rolls for use in a four-high rolling stand to roll sheet and/or wide plate, the rolls (11, 12) being supported by chocks (13) and cooperating axially with connecting liners (16) associated with the spindles (15) connected to the drive means, the device comprising a support and travel unit (28) with a first inactive position (28*a*) and a second active position (28*b*) of temporal support and maintenance in position at least of the liner elements (16), the travel and support unit (28) comprising a plate (20) associated with lifting means (19) and including in a substantially central position an aperture (21) to receive the liner (16) associated with the lower roll (12), and at the upper end, a positioning hollow (22) which cooperates, when the travel and support unit (28) is in its active position (28*b*), with the liner (16) associated with the upper roll (11).

7 Claims, 2 Drawing Sheets

DEVICE TO REPLACE THE ROLLS IN A FOUR-HIGH ROLLING STAND FOR SHEET AND/OR WIDE PLATE

BACKGROUND OF THE INVENTION

This invention concerns a device to replace rolling rolls.

To be more exact, the invention is applied in a four-high rolling stand for working sheet and/or wide plate to make it possible, easy and quick to extract and then insert the rolling rolls.

The state of the art covers rolling stands for sheet and/or wide plate which have opposite working rolls, respectively upper and lower, which define the rolling plane and are mounted on relative chocks, the chocks being arranged on one side and the other of the rolling stand, held to the moving systems by means of the appropriate coupling devices.

The state of the art covers the need to extract the rolls from the rolling stands, in order to replace them or to recondition their working surface.

The operation to extract the roll substantially entails releasing the coupling devices from the chocks of the rolls in order to disengage the rolls from the moving systems, after which the rolls are withdrawn axially from the rolling stand.

When the rolls are replaced, the above operations to extract the rolls are substantially followed in reverse order.

In state of the art rolling stands, after the coupling devices have been released from the relative rolls, it is possible that the coupling devices, once freed from constraints that can hold them in their original position, may interfere in the operations of extraction and/or replacement of the rolls and/or modify their position.

In particular, the liner element which associates the roll with the relative spindle connected to the motor can be disaligned with respect to the mounting position and make the operations to replace the roll extremely difficult and complex.

Moreover, the liner element finds itself in an inner position which makes it difficult to centre the rolls when they are being inserted.

As a result, these operations to insert the rolls are less easy because it is necessary to carry out other operations to centre the rolls and to align the chocks of the rolls with the relative mounting devices.

U.S. Pat. No. 3.543.556 discloses a system with two independent supports which, while the rolls are being changed, present the axis of the lower roll at a fixed height, whereas the axis of the upper working roll is at a variable height. In fact, the lower working roll is positioned by the rails which, while the rolls are being changed, are raised to a fixed position, and thus raise, by means of wheels, the chocks of the lower working roll to a fixed position in their turn.

The upper working roll, on the contrary, rests directly on the lower roll, in contact with the generating line; therefore, while the rolls are being changed, the axis of the upper roll is at a height which is a function of the diameters of the working rolls installed (or to be installed) in the rolling stand. This creates problems for the correct movement of the upper rolls.

This document moreover has the disadvantage that it requires a system to control the position of the support for the liner element of the upper spindle, which means that it is necessary to install a position transducer, an electronic control and the appropriate oil-dynamic valves (or electric motor) which are suitable for this purpose.

DE-B-1.022.997 refers to a system to replace the spindles and not a system to support the liner elements of the spindles while the working rolls are changed.

Therefore the system disclosed by this document is not provided with the equipment required by this invention, that is to say: a system of shifting, a system of clamping the chocks of the working rolls, a system to connect the actuators which perform the shifting and the system to clamp the chocks achieved by the "arms".

Moreover the prior art document includes two independent supports governed by the same roll.

Summary Of The Invention

The present applicants have designed, tested and embodied this invention to overcome the shortcomings of the state of the art and to achieve further advantages.

The purpose of this invention is to provide a device to extract the rolling rolls which is compact and simple both in construction and in use.

Another purpose of the invention is to simplify the operations to extract and insert the rolls from/into the rolling stands, and to make them extremely quick.

A further purpose of the invention is to ensure that, while the rolls are being changed, the axis of the working rolls are always at a fixed height.

The device according to the invention comprises a traveling and support unit which has a first inactive position during the normal functioning of the rolling rolls and a second active position while the rolls are being replaced; in this second position the axis of the rolls is always at the same fixed height.

The travel and support unit is activated in order to temporally support the coupling devices and the liner element until a determined position of extraction/insertion is reached, and also when necessary to allow a partial axial movement of the coupling devices and the liner element.

The device according to the invention consequently allows the coupling means to be released from the chocks associated with the rolls, in this way allowing the rolls to be extracted easily and quickly from the rolling mill stand.

The device according to the invention also allows the rolling rolls to be reinserted easily and quickly in that it maintains the coupling means and the mounting elements in the correct aligned position for extraction and insertion both during the extraction operation and when the extraction operation is completed.

When the operations to insert the rolling rolls are completed, the device according to the invention is actuated to take itself back to the original rest position.

According to a variant, the travel and support unit according to the invention is associated with axial movement means which allow the rolling rolls to carry out shifting and crossing movements, in order that the travel and support unit can substantially always act on the same work surfaces independently of the position the rolling rolls are in.

Brief Description Of The Drawing

The attached figures are given as a non-restrictive example and show a preferred embodiment of the invention as follows.

DETAILED DESCRIPTION OF THE PREFERRED EMBODIMENTS.

The reference number 10 in the figures attached generally denotes the replacement device for rolling rolls in its entirety according to the invention.

Figure 1:
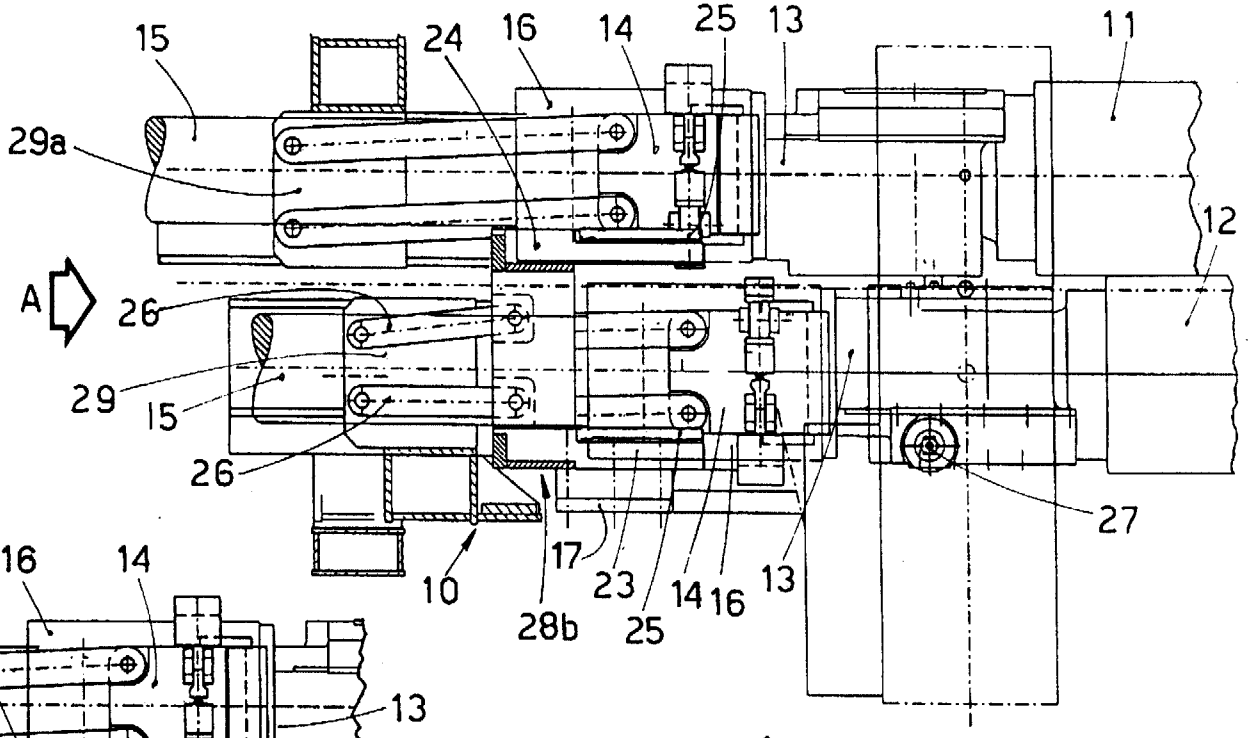
FIG.1 shows a partial side view of a rolling mill stand with two rolling rolls associated with the replacement device according to the invention in the active position.

The upper rolling roll 11 and the lower rolling roll 12, partially shown in FIG.1, are associated at their ends to chocks 13 which cooperate with jaws means 14 which have the function of making the rolls 11 and 12 solid with the axial moving means.

The rolls 11 and 12 also have drive means associated with them comprising a spindle 15 connected to the motor, and the end part of the motor facing the roll is axially associated with a connecting liner 16 between the spindle 15 and the end of the shaft of the roll 11, 12.

The roll replacement device 10 shown in FIGS. 1 to 4 has a travel and support unit 28 comprising a base 17 with whose ends support elements 18 are associated, each of which is connected to a lifting unit 19.

It should be noted that the base 17 is moved by extensions or support elements 18 which support the cylinders while they are being changed, and this obviates the necessity for further lifting means.

The support means 18 are the extensions of the rails on which the wheels or pads of the chocks of the lower working roll rest.

On the base 17 a plate 20 is solidly attached, the plate 20 having a through aperture 21 to receive the liner 16 associated with the shaft of the lower rolling roll 12, the plate 20 having at the top a hollow 22 so that the plate 20 does not interfere with the liner 16 associated with the upper roll 11.

Substantially in correspondence with its top parts, the plate 20 has two upper longitudinal support elements 24 and two lower longitudinal support elements 23 arranged substantially parallel to the surface of the liners 16. The longitudinal support elements 23 and 24 have contact elements 25 at the top, advantageously in anti-friction material, which extend lengthwise for at least part of the length of the elements 23 and 24.

The plate 20 is hinged to a head 29 by means of arms 26.

By means of the arms 26, the device according to the invention makes it possible to maintain the contact elements 25 always in the proximity of the liners 16 in that, as the base 17 is free to run on the support elements 18, the travel and support unit 28 solidly follows the axial travels caused by the heads 29 and **29*a* respectively to the rolling rolls 12 and 11**

Figure 2:
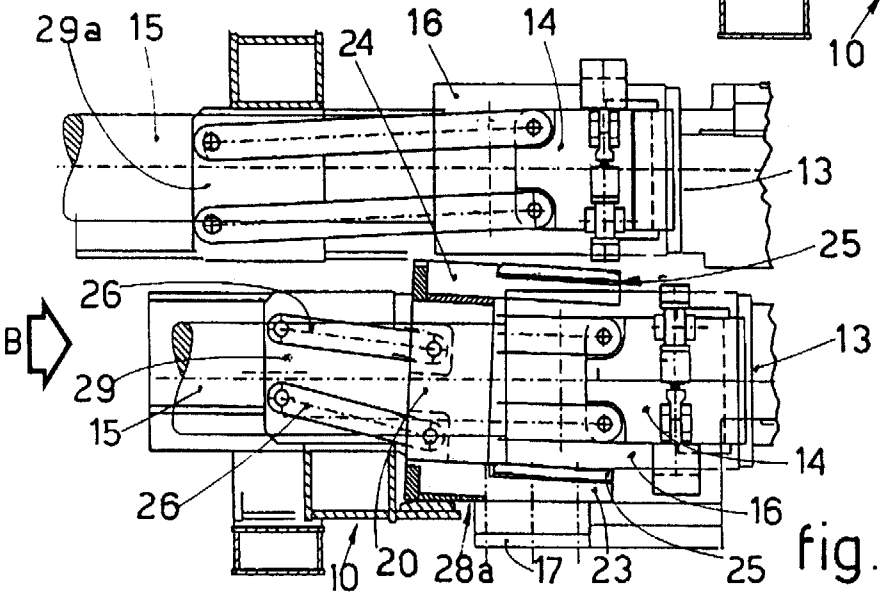
FIG.2 shows a partial view of FIG.1 with the device according to the invention in the inactive position.
Figure 4:
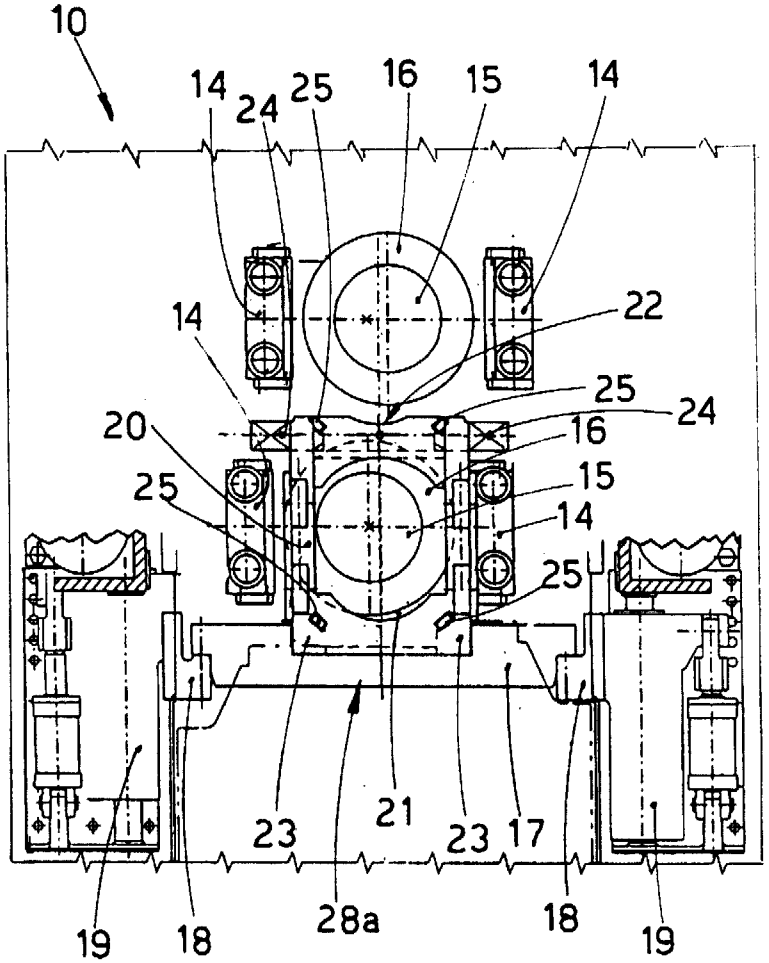
FIG.4 shows a view of FIG.2 from B.

During a normal rolling cycle, the travel and support unit 28 is in its inactive position **28*a* or lowered, as shown in FIGS. 2 and 4**, and has no effect on the normal rolling operations.

Figure 3:
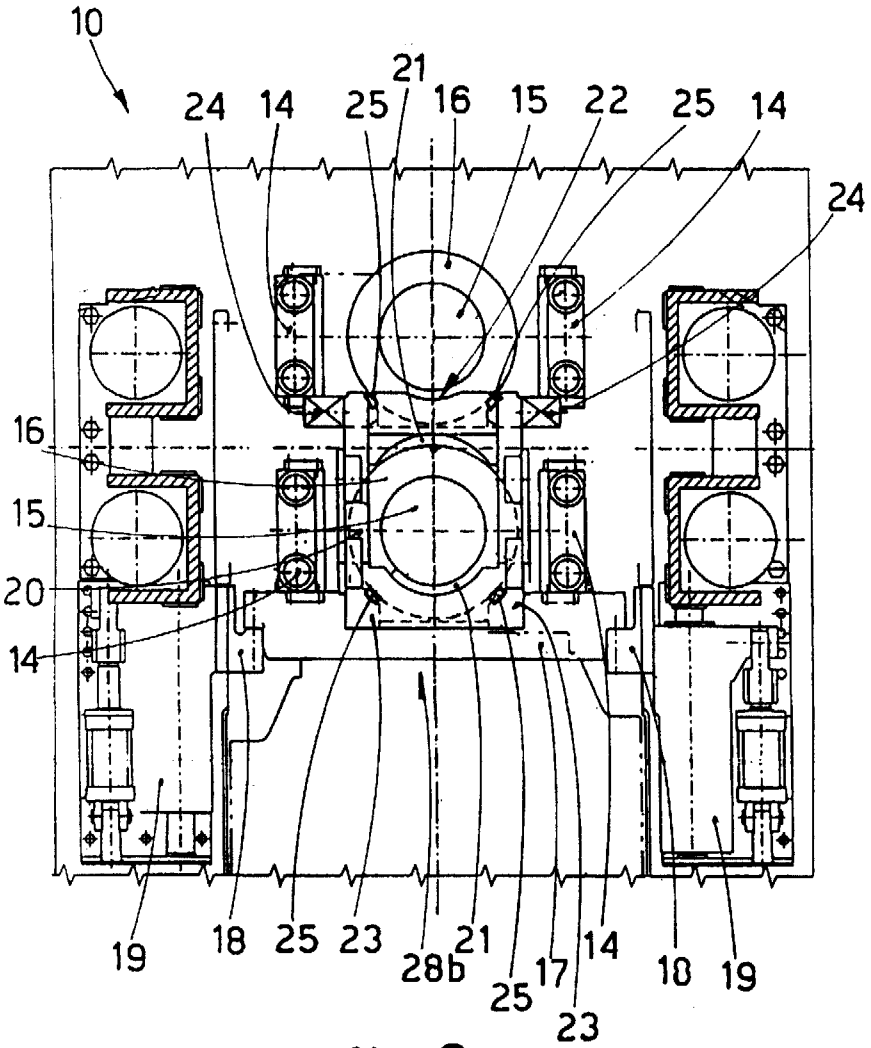
FIG.3 shows a view of FIG.1 from A.

When it becomes necessary to replace one or both the rolls 11, 12 or to carry out maintenance work on them, the travel and support unit 28 is raised (FIGS. 1 and 3) by means of the lifting units 19 (FIGS. 3 and 4) and taken to the active position **28*b*, or raised, as shown in FIGS. 1 and 3**.

In this case, the raising of the travel and support unit 28 brings the contact elements 25 into contact with the liner 16 associated with the lower roll 12, and causes a partial raising of the liner 16-roll 12 combination.

This raising continues until the contact elements 25 on the upper longitudinal support elements 24 come into contact with the liner 16 associated with the upper roll 11.

In this position **28*b* therefore, both liners 16 are temporally supported at the travel and support unit 28**.

When the travel and support unit 28 is in this position **28*b*, the jaw means 14 are opened, thus releasing the chocks 13 and allowing the rolls 11 and 12** to be extracted.

To make the extraction operations easier and to bring the liner 16 into a more outer position facing the operator's side of the rolling stand, in this case a pair of wheels 27 which can run in the appropriate guides is associated with the chock 13 of the lower roll 12.

When the rolls 11 and 12 have been extracted, the travel and support unit 28 stays in the same working position **28*b*; in subsequent operations to insert the rolls 11 and 12 the liners 16** and all the other mounting elements are aligned in the correct mounting position and in a position partially facing the operator's side of the rolling stand.

When the rolls 11 and 12 have been mounted, the travel and support unit 28 is taken back to its original position, lowered, the jaw means 14 close on the chocks 13 and the rolling cycle can be restarted.

We claim:

1. Device to replace rolling rolls for use in a four-high rolling stand for sheet or wide plate, the rolls comprising upper and lower rolls supported by chocks and cooperating axially with connecting liners associated with spindles connected with drive means, the device comprising a travel and support unit with a first inactive position and a second active position to temporally support and maintain in position at least the liner elements during extraction and insertion of either the upper roll or the lower roll and when the extraction operation is completed, the travel and support unit comprising a plate associated with lifting means and having in a substantially central position an aperture to receive an liner associated with the lower roll and at the upper end a positioning hollow cooperating, when the travel and support unit is in its active position, with the liner associated with the upper roll.

2. Device as in claim 1, in which the plate has, substantially in correspondence with its top parts, lower longitudinal support elements which cooperate with the liner associated with the lower roll and upper longitudinal support elements which cooperate with the liner associated with the upper roll.

3. Device as in claim 1, in which the plate is hinged by arms to a head which is solidly associated with an axial movement system of the rolls.

4. Device as in claim 1, in which at least the chocks of the lower roll have wheels for axial movement.

5. Device as in claim 1, in which the travel and support unit is associated with support and vertical movement elements which are associated with the cylinders while they at least one cylinder while the elements are being changed.

6. Device as in claim 2, in which the upper and lower longitudinal support elements have contact elements at their upper ends, advantageously in anti-friction material.

7. A four-high rolling stand for sheet or wide plate comprising upper and lower rolls supported by chocks and cooperating laterally with connecting liners associated with spindles connected with drive means, and a device to replaces the rolls, the device comprising a travel and a support unit with a first inactive position and a second active position to temporally support and maintain in position at least the liner elements during extraction and insertion of either the upper roll or the lower roll and when the extraction operation is completed, the travel and support unit comprising a plate associated with lifting means and having in a substantially central position an aperture to receive the liner associated with an lower roll and at the upper end a positioning hollow cooperating, when the travel and support unit is in its active position, with the liner associated with the upper roll.

* * * * *